US010072604B2

(12) United States Patent
Mc Clearen et al.

(10) Patent No.: US 10,072,604 B2
(45) Date of Patent: Sep. 11, 2018

(54) ENGINE BLOCK CONSTRUCTION FOR OPPOSED PISTON ENGINE

(71) Applicant: AVL Powertrain Engineering, Inc., Plymouth, MI (US)

(72) Inventors: James Mc Clearen, Brighton, MI (US); Jeffrey Wayne Klaver, Ypsilanti, MI (US); Gary L. Hunter, Brighton, MI (US)

(73) Assignee: AVL POWERTRAIN ENGINEERING, INC., Plymouth, MI (US)

( * ) Notice: Subject to any disclaimer, the term of this patent is extended or adjusted under 35 U.S.C. 154(b) by 198 days.

(21) Appl. No.: 15/050,638

(22) Filed: Feb. 23, 2016

(65) Prior Publication Data

US 2016/0252044 A1 Sep. 1, 2016

Related U.S. Application Data

(60) Provisional application No. 62/121,777, filed on Feb. 27, 2015, provisional application No. 62/126,088, filed on Feb. 27, 2015.

(51) Int. Cl.
*F02B 75/28* (2006.01)
*F02F 1/18* (2006.01)
(Continued)

(52) U.S. Cl.
CPC ..... *F02F 1/186* (2013.01); *F01B 7/14* (2013.01); *F02B 75/28* (2013.01); *F02B 75/282* (2013.01); *F02F 1/004* (2013.01); *F02F 1/22* (2013.01)

(58) Field of Classification Search
CPC ..... F02F 1/186; F02F 1/22
(Continued)

(56) References Cited

U.S. PATENT DOCUMENTS 2,068,038 A * 1/1937 Prothero ..... F01B 3/045 123/41.72
2,421,868 A * 6/1947 Bovee ..... F01B 3/02 123/51 B
(Continued)

FOREIGN PATENT DOCUMENTS

CN 204164363 U * 2/2015
DE 19646930 A1 5/1997
(Continued)

OTHER PUBLICATIONS

U.S. Appl. No. 15/050,707, filed Feb. 23, 2016, James Mc Clearen, et al.
(Continued)

*Primary Examiner* — Marguerite McMahon
(74) *Attorney, Agent, or Firm* — Harness, Dickey & Pierce, P.L.C.

(57) ABSTRACT

An opposed-piston engine assembly is disclosed including a first cylinder liner containing a pair of first pistons that move toward one another in one mode of operation and away from one another in another mode of operation. The pistons are coupled to first and second crankshafts. Multiple block segments arranged in a side-by-side abutting relationship form the engine block including a first outboard segment, a first inboard segment, a second inboard segment, and a second outboard segment. Tensile members extend through the block segments tying them together as one structural unit. The first and second inboard segments abut one another at a seam and include bores that cooperate to receive the first cylinder liner. The first cylinder liner includes a liner support collar that is received in counter-bores defined by the first and second inboard segments at the seam between the first and second inboard segments.

27 Claims, 5 Drawing Sheets

(51) Int. Cl.
*F01B 7/14* (2006.01)
*F02F 1/00* (2006.01)
*F02F 1/22* (2006.01)

(58) Field of Classification Search
USPC ..... 123/51 R–51 BD, 193.2
See application file for complete search history.

(56) References Cited

U.S. PATENT DOCUMENTS

| | | | | |
|---|---|---|---|---|
| 2,423,395 | A | 7/1947 | Lieberherr | |
| 2,446,841 | A † | 8/1948 | Lieberherr | |
| 2,703,077 | A | 3/1955 | Antonsen | |
| 2,853,983 | A | 9/1958 | Sawle | |
| 2,996,050 | A | 8/1961 | Caris | |
| 2,998,808 | A | 9/1961 | Jackson | |
| 3,023,743 | A | 3/1962 | Schauer | |
| 3,084,678 | A | 4/1963 | Lindsay | |
| 3,320,940 | A | 5/1967 | Mitchell et al. | |
| 4,013,058 | A | 3/1977 | Hafner et al. | |
| 4,216,747 | A † | 8/1980 | Noguchi | |
| 4,527,516 | A * | 7/1985 | Foster | F02B 25/04 123/27 GE |
| 4,638,769 | A | 1/1987 | Ballheimer | |
| 4,706,616 | A | 11/1987 | Yoshimitsu | |
| 4,953,528 | A | 9/1990 | Oikawa et al. | |
| 5,188,066 | A † | 2/1993 | Gustavsson | |
| D370,712 | S | 6/1996 | Clark et al. | |
| 5,727,512 | A | 3/1998 | Hutchins | |
| 7,360,511 | B2 | 4/2008 | Lemke et al. | |
| 7,591,235 | B2 † | 9/2009 | Lemke | |
| 8,413,619 | B2 † | 4/2013 | Cleeves | |
| 8,539,918 | B2 | 9/2013 | Lemke et al. | |
| 8,549,854 | B2 * | 10/2013 | Dion | F02F 1/186 123/46 R |
| 8,789,499 | B2 † | 7/2014 | Alonso | |
| 9,121,365 | B1 | 9/2015 | Wagner | |
| 9,328,692 | B2 † | 5/2016 | Rado | |
| 9,435,290 | B2 † | 9/2016 | Fuqua | |
| 9,771,861 | B2 | 9/2017 | McClearen et al. | |
| 2007/0245892 | A1 † | 10/2007 | Lemke | |
| 2010/0071671 | A1 * | 3/2010 | Lemke | F01B 7/14 123/51 R |
| 2010/0116240 | A1 | 5/2010 | Campbell et al. | |
| 2012/0078491 | A1 † | 3/2012 | Erlandsson | |
| 2013/0025548 | A1 | 1/2013 | Liu et al. | |
| 2016/0069293 | A1 | 3/2016 | McClearen et al. | |
| 2016/0177862 | A1 | 6/2016 | Batta et al. | |
| 2016/0252043 | A1 | 9/2016 | Mc Clearen et al. | |
| 2016/0273470 | A1 † | 9/2016 | Lippitt | |
| 2016/0356239 | A1 * | 12/2016 | Graham | F02F 1/004 |

FOREIGN PATENT DOCUMENTS

| | | | | |
|---|---|---|---|---|
| DE | 102012024177 | A1 | 6/2014 | |
| EP | 2980392 | A2 * | 2/2016 | F02F 1/004 |
| FR | 437089 | A | 4/1912 | |
| FR | 2803874 | A1 † | 7/2001 | |
| FR | 2957631 | A1 † | 9/2011 | |
| GB | 247218 | * | 2/1925 | |
| GB | 851353 | A | 10/1960 | |
| GB | 2172651 | A | 9/1986 | |
| JP | 62038459 | U | 3/1987 | |
| JP | 63243572 | A | 10/1988 | |
| JP | 03021546 | U | 3/1991 | |

OTHER PUBLICATIONS

Extended European Search Report for Application No. 16157508.9 dated Jul. 1, 2016.
Pirault, Jean-Pierre et al. Opposed-Piston Engine Renaissance. 2010 Archates Power, Inc. pp. 1-17.
The Junkers Jumo 205 Diesel Engine. Chapter 4. 7 pages.
Ralph Hosier's TechnoBlog. Opposed Pistons. [online]. Jun. 10, 2011.<URL:https://ralphhosier.wordpress.com/2011/06/10/opposed-pistons/>.
Regner, Gerhard. Modernizing the Opposed-Piston, Two-Stroke Diesel Engine for More Efficient Commercial Vehicle Applications. 2012 Achates Power, Inc. pp. 1-26.
Extended European Search Report for Application No. 16157520.4 dated Jul. 25, 2016.

* cited by examiner
† cited by third party

ENGINE BLOCK CONSTRUCTION FOR OPPOSED PISTON ENGINE

CROSS-REFERENCE TO RELATED APPLICATIONS

This application claims the benefit of U.S. Provisional Application No. 62/121,777, filed on Feb. 27, 2015, and U.S. Provisional Application No. 62/126,088, filed on Feb. 27, 2015. Additionally, this application is related to U.S. Utility Application Ser. No. 15/050,707, entitled "Opposed Piston Two Stroke Engine Liner Construction"), filed concurrently herewith. The entire disclosures of the applications referenced above are incorporated herein by reference.

FIELD

The present disclosure generally relates to internal combustion engines. More particularly, an engine block assembly is disclosed for an opposed-piston engine.

BACKGROUND

This section provides background information related to the present disclosure which is not necessarily prior art.

Opposed-piston engines generally include two pistons housed within each cylinder that move in an opposed, reciprocal manner within the cylinder. In this regard, during one stage of operation the pistons are moving away from one another within the cylinder and during another stage of operation the pistons are moving towards one another within the cylinder. As the pistons move towards one another within the cylinder, they compress and, thus, cause ignition of a fuel/air mixture disposed within the cylinder. In so doing, the pistons are forced apart from one another, thereby exposing the inlet ports and the exhaust ports. Exposing the inlet ports draws air into the cylinder and this in combination with exposing the exhaust ports expels exhaust, thereby allowing the process to begin anew. When the pistons are forced apart from one another, connecting rods respectively associated with each piston transfer the linear motion of the pistons relative to and within the cylinder to one or more crankshafts associated with the connecting rods. The longitudinal forces imparted on the crankshafts cause rotation of the crankshafts which, in turn, cause rotation of wheels of a vehicle in which the engine is installed.

Generally speaking, opposed-piston engines include a bank of cylinders with each cylinder having a pair of pistons slidably disposed therein. While the engine may include any number of cylinders, the particular number of cylinders included is generally dictated by the type and/or required output of the vehicle. For example, in an automobile, fewer cylinders may be required to properly propel and provide adequate power to the vehicle when compared to a heavier vehicle such as a commercial truck, a ship, or tank. Accordingly, a light vehicle may include an engine having four (4) cylinders and eight (8) pistons while a heavier vehicle may include six (6) cylinders and twelve (12) pistons.

Such opposed piston engines have a one piece engine block (i.e. made from a single casting), that includes one cylinder bore per cylinder. The one piece engine block further includes two crankcases, one disposed to one side of the cylinder bores and the other disposed on an opposite side of the cylinder bores. A liner may be inserted into each of the cylinder bores from one of the crankcases. In order to properly accommodate and seal the liner in the one piece engine block, complicated machining in the cylinder bore is required and access to the cylinder bore is limited. This adds to manufacturing time and cost. The liner may be supported on one end to avoid rocking and to limit axial movement of the liner within the cylinder bore. For example, the liner may have an annular collar disposed at an end opposite the end of the liner that is first inserted into the cylinder bore. As such, the liner is inserted into the cylinder bore until the annular collar contacts the engine block.

SUMMARY

This section provides a general summary of the disclosure, and is not a comprehensive disclosure of its full scope or all of its features.

In accordance with one aspect of the subject disclosure, an opposed-piston engine assembly is provided. The opposed-piston engine assembly includes an engine block and a first cylinder liner that is disposed within the engine block. The first cylinder liner defines a first cylinder for receiving a first piston and a first opposing piston. The first cylinder has a first longitudinal axis that extends coaxially through the first cylinder. The engine block has multiple block segments that are disposed in a side-by-side abutting relationship including a first inboard segment and a second inboard segment. The first inboard segment defines a first bore and the second inboard segment defines a second bore. The first bore of the first inboard segment is arranged in fluid communication with the second bore of the second inboard segment. Additionally, the first and second bores are co-axial with the first longitudinal axis of the first cylinder. The first and second bores are aligned with one another such that the first and second bores cooperate to receive the first cylinder liner. Such an arrangement allows the first cylinder liner to be installed in the engine block more easily. Rather than driving the first cylinder liner into the engine block from one end, part of the first cylinder liner is simply inserted into the first bore of the first inboard segment and the other part of the first cylinder liner is inserted into the second bore of the second inboard segment. The first and second inboard segments are then pushed together in a side-by-side abutting relationship such that the engine block is essentially assembled around the first cylinder liner. Advantageously, this arrangement provides improved access to various areas of the engine block such that the need for complicated machining operations to accommodate and seal the first cylinder liner is eliminated.

In accordance with another aspect of the subject disclosure, the first cylinder liner has a longitudinal extent equaling a predetermined length. The first cylinder liner also has a cylinder wall presenting an inner surface that defines the first cylinder and an outer surface that is opposite the inner surface. The first cylinder liner includes a liner support collar disposed intermediately along the longitudinal extent of the first cylinder liner that extends annularly about and radially from the outer surface of the first cylinder liner to form a stop. The first inboard segment extends longitudinally between a first proximate end and a first distal end. The first bore of the first inboard segment is open to at least the first proximate end. The second inboard segment extends longitudinally between a second proximate end and a second distal end. The second bore of the second inboard segment is open to at least the second proximate end. The first proximate end of the first inboard segment and the second proximate end of the second inboard segment abut one another such that the first bore is aligned with the second bore. Accordingly, the first bore and the second bore jointly receive the first cylinder liner. At least one of the first proximate end of the first inboard segment and the second proximate end of the second inboard segment has a counter-bore. The counter-bore is coaxially aligned with and extends annularly about one of the first bore and the second bore to receive at least part of the liner support collar of the first cylinder liner. Such an arrangement provides improved liner support because the first cylinder liner is supported at an intermediate location along the longitudinal extent of the first cylinder liner rather than at one of two distal ends of the first cylinder liner like in other liner arrangements.

In accordance with another aspect of the subject disclosure, the opposed piston engine includes a plurality of cylinder liners disposed within the engine block including the first cylinder liner and a second cylinder liner. The first cylinder liner defines the first cylinder and the second cylinder liner defines a second cylinder. The second cylinder has a second longitudinal axis that extends coaxially through the second cylinder. The second cylinder is disposed adjacent to the first cylinder in the engine block such that the first longitudinal axis of the first cylinder is parallel with and spaced from the second longitudinal axis of the second cylinder. A pair of second pistons are slidably disposed within the second cylinder. The pair of second pistons includes a second piston and second opposing piston that are movable along the second longitudinal axis toward one another in the first mode of operation and away from one another in the second mode of operation.

The first crankshaft is coupled to the first piston of the first pair of pistons and to the second piston of the second pair of pistons by a first pair of connecting rods. The first axis of rotation of the first crankshaft is substantially perpendicular to both the first longitudinal axis of the first cylinder and the second longitudinal axis of the second cylinder. The second crankshaft is coupled to the first opposing piston of the first pair of pistons and to the second opposing piston of the second pair of pistons by a second pair of connecting rods. The second axis of rotation of the second crankshaft is substantially perpendicular to both the first longitudinal axis of the first cylinder and the second longitudinal axis of the second cylinder. The second axis of rotation of the second crankshaft is also substantially parallel to and spaced from the first axis of rotation of the first crankshaft. The first cylinder and the second cylinder may thus be positioned longitudinally between the first crankshaft and the second crankshaft even though the first longitudinal axis of the first cylinder and the second longitudinal axis of the second cylinder may or may not be arranged in the same plane as the first axis of rotation of the first crankshaft and the second axis of rotation of the second crankshaft.

The multiple block segments of the engine block include a first inboard segment, a second inboard segment, a first outboard segment, and a second outboard segment, all of which are disposed in a side-by-side abutting relationship. The first inboard segment extends longitudinally between a first proximate end and a first distal end and the second inboard segment extending longitudinally between a second proximate end and a second distal end. The first inboard segment defines a first plurality of bores that extend entirely through the first inboard segment from the first proximate end to the first distal end. Each bore of the first plurality of bores receives part of one cylinder liner of the plurality of cylinder liners. The second inboard segment defines a second plurality of bores that extend entirely through the second inboard segment from the second proximate end to the second distal end. Each bore of the second plurality of bores receives part of one cylinder liner of the plurality of cylinder liners. The first proximate end of the first inboard segment and the second proximate end of the second inboard segment abut one another such that the first plurality of bores in the first inboard segment are aligned with the second plurality of bores in the second inboard segment. Accordingly, the first plurality of bores and the second plurality of bores cooperate to receive the plurality of cylinder liners.

The first outboard segment extends longitudinally between a third proximate end and a third distal end and at least partially defines a first crankcase therein that receives the first crankshaft. The third proximate end of the first outboard segment abuts the first distal end of the first inboard segment such that the first inboard segment is disposed longitudinally between the second inboard segment and the first outboard segment. The second outboard segment extends longitudinally between a fourth proximate end and a fourth distal end and at least partially defines a second crankcase therein that receives the second crankshaft. The fourth proximate end of the second outboard segment abuts the second distal end of the second inboard segment such that the second inboard segment is disposed longitudinally between the first inboard segment and the second outboard segment. A strong and lightweight multi-piece engine block is thus formed for an opposed-piston engine. Advantageously, the multiple block segments disclosed are easily manufactured and facilitate assembly of the opposed-piston engine by providing superior access to internal engine components when compared to other opposed-piston engine designs.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1:
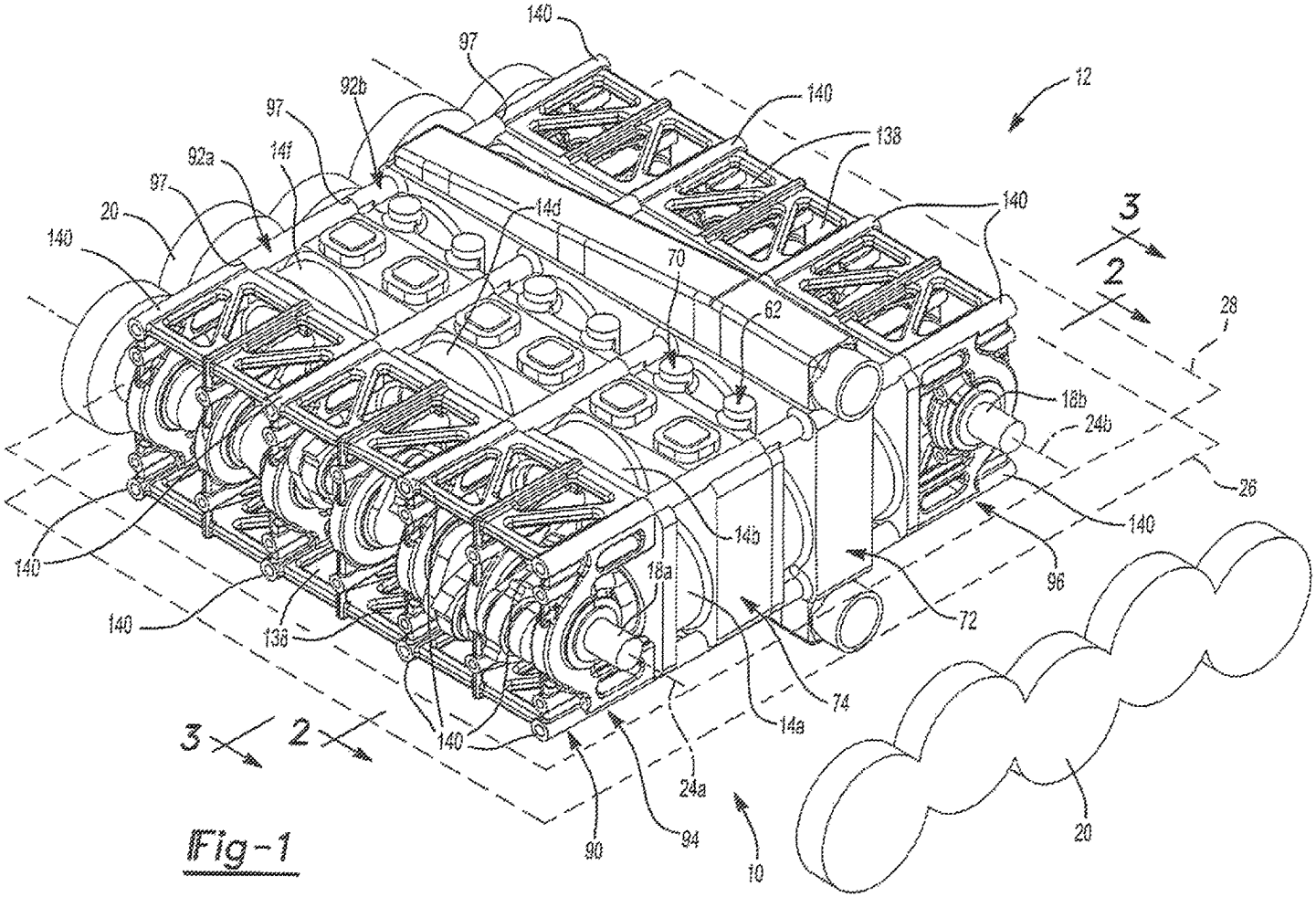
FIG. 1 is a partial perspective view of an exemplary opposed piston engine constructed in accordance with the subject disclosure having an engine block assembly defined by four block segments.

Referring to the Figures, wherein like numerals indicate corresponding parts throughout the several views, an engine block assembly 10 of an opposed-piston engine 12 is disclosed.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring generally to FIGS. 1 through 4, an engine block assembly 10 is illustrated for an opposed-piston engine 12. It should be appreciated that the engine block assembly 10 comprises part of a larger opposed-piston engine 12. For example, several intake, exhaust, cooling, and control components are not illustrated in the Figures. The opposed-piston engine 12 may be of a variety of different types, including without limitation, a two-stroke engine or a four-stroke engine. Further, the opposed-piston engine 12 may be designed to run on one or more of a variety of different fuels, including diesel fuel (e.g. a compression-ignition engine) and gasoline (e.g. a spark-ignition engine).

With reference to FIG. 1, the engine block assembly 10 of the opposed-piston engine may define a series of cylinders 14*a*-14*f*. Each cylinder includes a pair of pistons 16*a*, 16*b* slidably disposed therein and selectively movable toward one another (FIG. 2) and away from one another (FIG. 3). Movement of the pistons 16*a*, 16*b* relative to and within the cylinders 14*a*-14*f* drives a pair of crankshafts 18*a*, 18*b* which, in turn, drive a gear train 20. The gear train 20 may be connected to driven wheels of a vehicle (not shown), for example, whereby the pair of crankshafts 18*a*, 18*b* and the gear train 20 cooperate to transform the linear motion of the pistons 16*a*, 16*b* relative to the cylinders into rotational motion to allow the motion of the pistons 16*a*, 16*b* to rotate the driven wheels and propel the vehicle.

The cylinders 14*a*-14*f* are housed within the engine block assembly 10 and each includes a longitudinal axis 22*a*-22*f* that extends substantially perpendicular to a rotational axis 24*a*, 25*b* of each crankshaft 18*a*, 18*b*. As shown in FIG. 1, the cylinders 14*a*-14*f* may be offset from one another such that some of the cylinders nest with one another.

The longitudinal axes of the cylinders 14*a*, 14*c*, 14*e* are aligned with one another such that a primary cylinder plane 26 intersecting each of the longitudinal axes 22*a*, 22*c*, 22*e* of cylinders 14*a*, 14*c*, 14*e* is created. The primary cylinder plane 26 is spaced from and is substantially parallel to the rotational axes 24*a*, 24*b* of the crankshafts 18*a*, 18*b*. Similarly, a secondary cylinder plane 28 intersecting the longitudinal axes 22*b*, 22*d*, 22*f* of the cylinders 14*b*, 14*d*, 14*f* is created. The secondary cylinder plane 28 is spaced from and is substantially parallel to the rotational axes 24*a*, 24*b* of the crankshafts 18*a*, 18*b*. The primary cylinder plane 26 is substantially parallel to and is offset from the secondary cylinder plane 28 and the primary cylinder plane 26 is disposed on an opposite side of the rotational axes 24*a*, 24*b* of the crankshafts 18*a*, 18*b* than the secondary cylinder plane 28.

Accordingly, the configuration of the cylinders 14*a*-14*f* shown in FIG. 1 creates a so-called "nested" arrangement of the cylinders 14*a*-14*f*, which allows the cylinders 14*a*-14*f* to be packaged in a smaller engine block. Notwithstanding, it should be appreciated that the scope of the present disclosure is not limited to this number of cylinders or the configuration illustrated in FIG. 1.

The cylinders 14*a*-14*f* of the opposed-piston engine 12 may be grouped into cylinder pairs where cylinders 14*a* and 14*b* are grouped in a first cylinder pair 30, cylinders 14*c* and 14*d* are grouped in a second cylinder pair 32, and cylinders 14*e* and 14*f* are grouped in a third cylinder pair 34. Because the relative structure and function of the first cylinder pair 30 is the same as the second and third cylinder pairs 32, 34, the following disclosure focuses on the first cylinder pair 30 with the understanding that the same also applies to the second and third cylinder pairs 32, 34 of the opposed-piston engine 12 illustrated in FIG. 1.

As shown in FIG. 1, a plurality of cylinder liners 36*a*-36*f* are disposed within the engine block assembly 10. Each cylinder liner of the plurality of cylinder liners 36*a*-36*f* defines a cylinder wall 38 that extends annularly about and defines a cylinder bore 40. The plurality of cylinder liners 36*a*-36*f* includes a first cylinder liner 36*a* that defines a first cylinder 14*a* and a second cylinder liner 36*b* that defines a second cylinder 14*b*. The cylinder liners 36*a*-36*f* may all be of the same length. For example, the first cylinder liner 36*a* and the second cylinder liner 36*b* each have a longitudinal extent 42 equaling a predetermined length.

Figure 2:
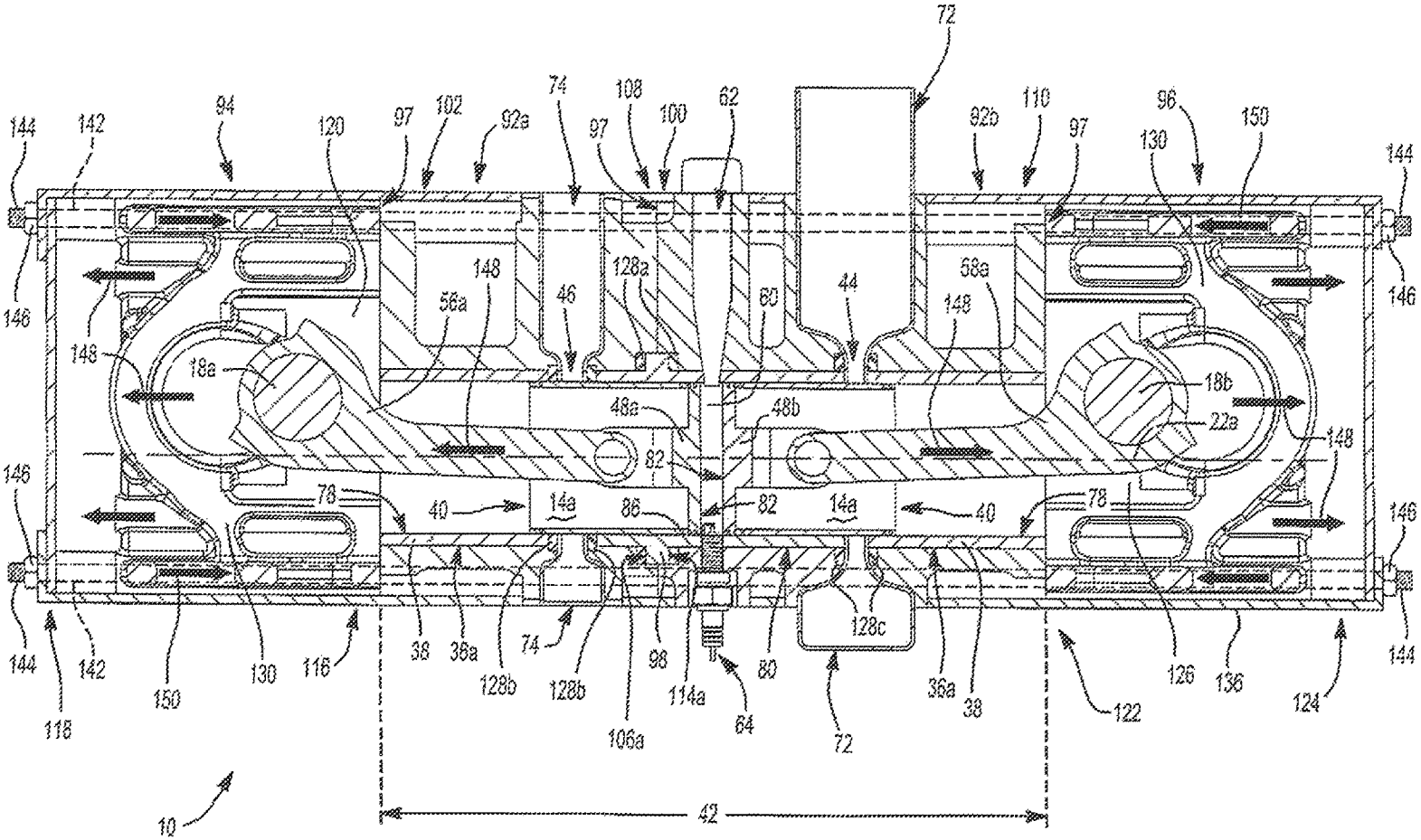
FIG. 2 is a cross-section view of the first cylinder of the exemplary opposed piston engine illustrated in FIG. 1 where the pair of first pistons are shown at a top dead-center position.
Figure 3:
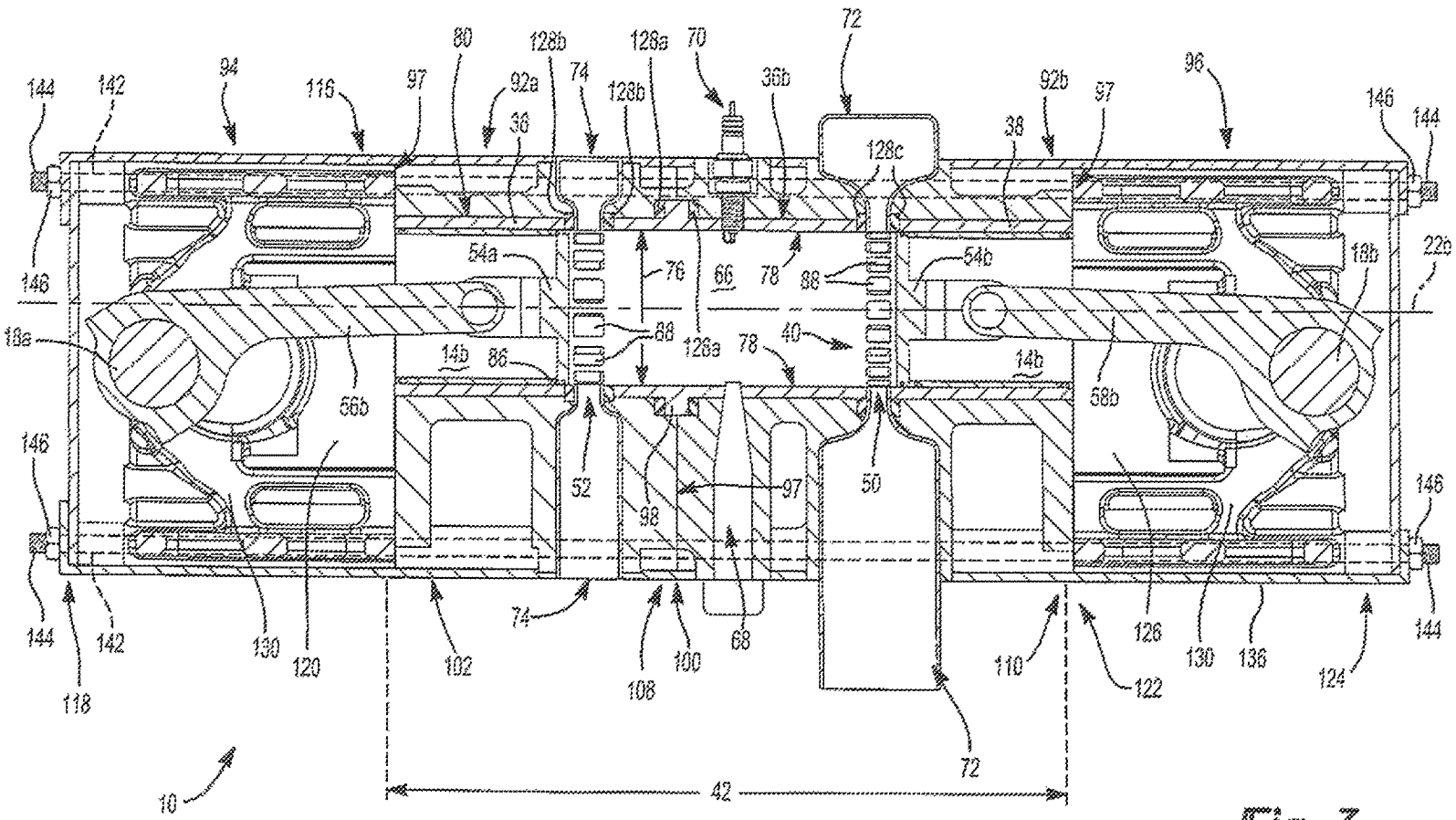
FIG. 3 is a cross-section view of the second cylinder of exemplary opposed piston engine illustrated in FIG. 1 where the pair of second pistons are shown at a bottom dead-center position.

As best seen in FIG. 2, the first cylinder 14*a* has a first longitudinal axis 22*a* that extends coaxially through the first cylinder 14*a*. The first cylinder 14*a* has a first inlet port 44 and a first exhaust port 46 that is longitudinally spaced from the first inlet port 44. Both the first inlet port 44 and the first exhaust port 46 extend through the cylinder wall 38 of the first cylinder liner 36*a* and are arranged in fluid communication with the cylinder bore 40 of the first cylinder 14*a*. A pair of first pistons 48*a*, 48*b* including a first piston 48*a* and a first opposing piston 48*b* are slidably disposed within the first cylinder 14*a* and are movable along the first longitudinal axis 22*a*. For example, the pair of first pistons 48*a*, 48*b* may move toward one another along the first longitudinal axis 22*a* in a first mode of operation and away from one another along the first longitudinal axis 22*a* in a second mode of operation as the pair of first pistons 48*a*, 48*b* translate between a bottom dead-center position and a top dead-center position (shown in FIG. 2). Accordingly, the first mode of operation and the second mode of operation occur sequentially during a single engine cycle.

Figure 5:
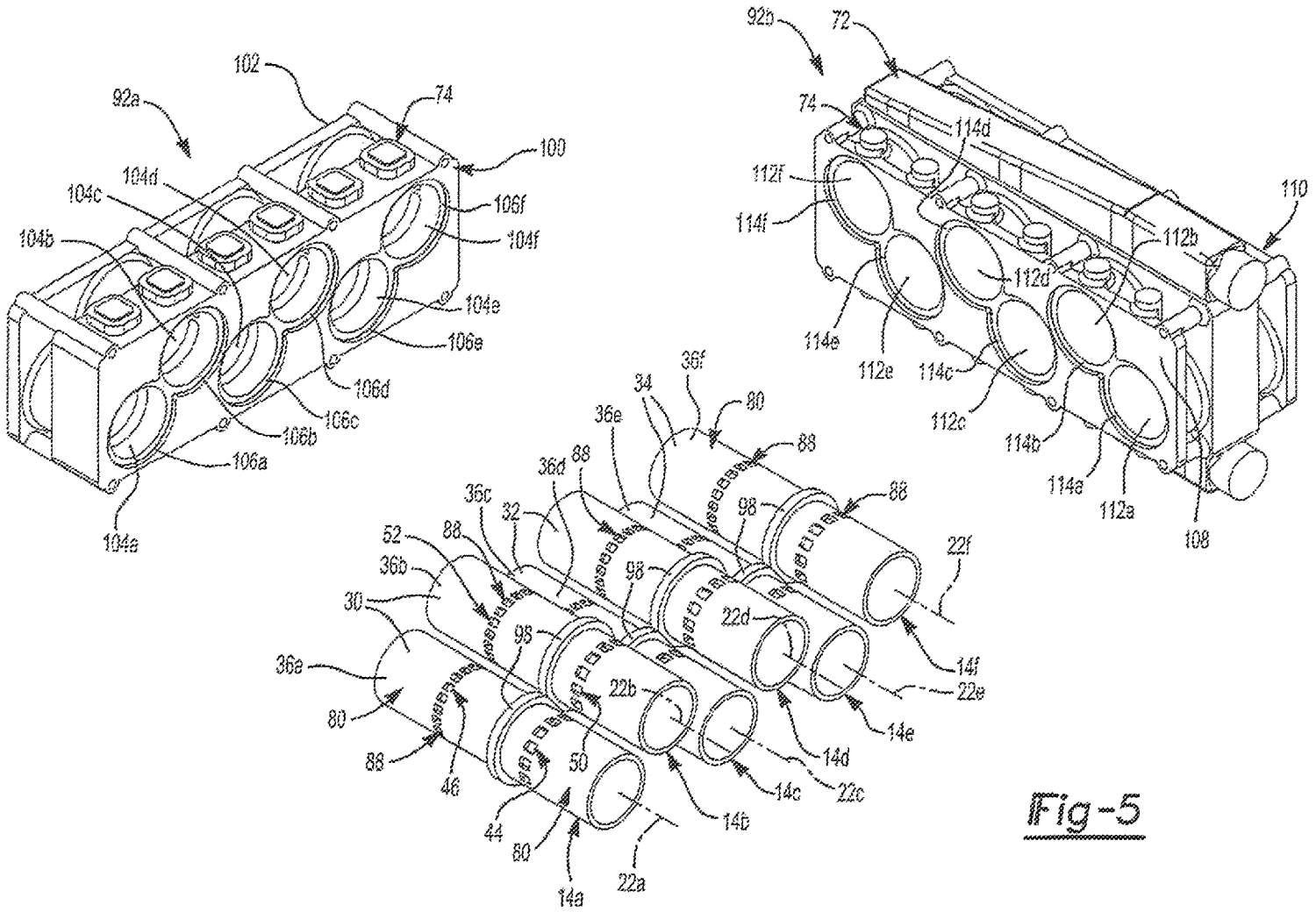
FIG. 5 is a partial exploded perspective view of a portion of the exemplary opposed piston engine illustrated in FIG. 4, where first and second inboard block segments have been rotated to illustrate the first plurality of counter-bores and the second plurality of counter-bores plurality.

With reference now to FIG. 3, the second cylinder 14*b* has a second longitudinal axis 22*b* that extends coaxially through the second cylinder 14*b*. The second cylinder 14*b* also has a second inlet port 50 and a second exhaust port 52 that is longitudinally spaced from the second inlet port 50. Both the second inlet port 50 and the second exhaust port 52 extend through the cylinder wall 38 of the second cylinder liner 36*b* and are arranged in fluid communication with the cylinder bore 40 of the second cylinder 14*b*. As shown in FIG. 1, the second cylinder 14*b* is disposed adjacent to the first cylinder 14*a* such that the first longitudinal axis 22*a* of the first cylinder 14*a* is parallel with and spaced from the second longitudinal axis 22*b* of the second cylinder 14*b*. Further, as best shown in FIG. 5, the first and second cylinders 14*a*, 14*b* are arranged such that the first inlet port 44 of the first cylinder 14*a* is longitudinally aligned with the second inlet port 50 of the second cylinder 14*b* and such that the first exhaust port 46 of the first cylinder 14*a* is longitudinally aligned with the second exhaust port 52 of the second cylinder 14*b*.

As shown in FIG. 3, a pair of second pistons 54*a*, 54*b* including a second piston 54*a* and second opposing piston 54*b* are slidably disposed within the second cylinder 14*b* and are movable along the second longitudinal axis 22*b*. For example, the pair of second pistons 54*a*, 54*b* may move toward one another in the first mode of operation and away from one another in the second mode of operation as the pair of second pistons 54*a*, 54*b* translate between the bottom dead-center position (shown in FIG. 3) and the top dead-center position. It should be appreciated that the first mode of operation and the second mode of operation occur sequentially during a single engine cycle.

Where the opposed-piston engine 10 is a two-stroke engine, the first mode of operation and the second mode of operation comprise the entirety of the single engine cycle. The intake charge is compressed during the first mode of operation and the intake charge ignites during the second mode of operation where the pistons 16*a*, 16*b* are driven apart and where a new intake charge enters the cylinder bore 40 and the exhaust gases are expelled. Alternatively, where the opposed-piston engine 10 is a four-stroke engine, the single engine cycle may include two of the first modes of operation and two of the second modes of operation. The single engine cycle may begin with the second mode of operation where the intake charge enters the cylinder bore 40 as the pistons 16*a*, 16*b* move apart. The intake charge is then compressed in the first mode of operation where the pistons 16*a*, 16*b* approach one another. The intake charge ignites and the combustion forces the pistons 16*a*, 16*b* apart in another second mode of operation. Next, the pistons 16*a*, 16*b* move in another first mode of operation where the pistons 16*a*, 16*b* again approach one another to expel exhaust gases out of the cylinder bore 40.

Figure 4:
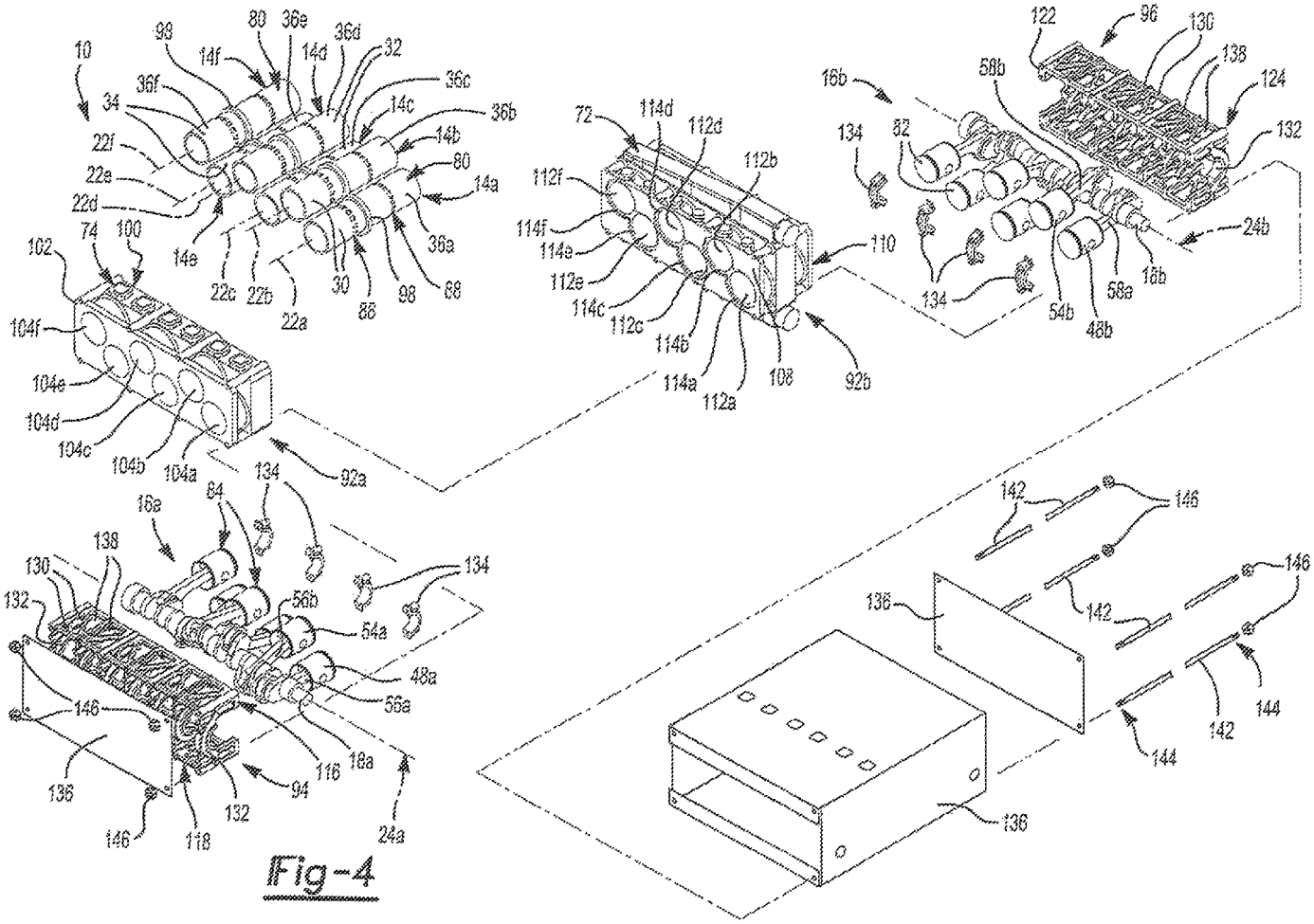
FIG. 4 is an exploded perspective view of the exemplary opposed piston engine illustrated in FIG. 1.

Referring to FIG. 4, the pair of crankshafts 18*a*, 18*b* includes a first crankshaft 18*a* and a second crankshaft 18*b*. The first crankshaft 18*a* is coupled to the first piston 48*a* of the pair of first pistons 48*a*, 48*b* and to the second piston 54*a* of the pair of second pistons 54*a*, 54*b* by a first pair of connecting rods 56*a*, 56*b*. The first crankshaft 18*a* rotates about a first axis of rotation 24*a* that is substantially perpendicular to the first longitudinal axis 22*a* and the second longitudinal axis 22*b*. Together, the first crankshaft 18*a* and the first pair of connecting rods 56*a*, 56*b* associate movement of the first piston 48*a* with movement the second piston 54*a*. Preferably, movement of the first piston 48*a* opposes movement of the second piston 54*a* where the first crankshaft 18*a* is configured such that the second piston 54*a* moves in accordance with the second mode of operation when the first piston 48*a* is moving in accordance with the first mode of operation. In other words, the arrangement of the first crankshaft 18*a* and the first pair of connecting rods 56*a*, 56*b* is such that the second piston 54*a* moves towards the second opposing piston 54*b* when the first piston 48*a* is moving away from the first opposing piston 48*b*.

The second crankshaft 18*b* is coupled to the first opposing piston 48*b* of the pair of first pistons 48*a*, 48*b* and to the second opposing piston 54*b* of the pair of second pistons 54*a*, 54*b* by a second pair of connecting rods 58*a*, 58*b*. The second crankshaft 18*b* rotates about a second axis of rotation 24*b* that is substantially perpendicular to the first longitudinal axis 22*a* and the second longitudinal axis 22*b*. The second axis of rotation 24*b* of the second crankshaft 18*b* is also substantially parallel to and spaced from the first axis of rotation 24*a* of the first crankshaft 18*a*. Accordingly, the first cylinder 14*a* and the second cylinder 14*b* are generally positioned between the first crankshaft 18*a* and the second crankshaft 18*b*, although the first cylinder 14*a* and the second cylinder 14*b* are not necessarily in the same plane as the first and second crankshafts 18*a*, 18*b*. Together, the second crankshaft 18*b* and the second pair of connecting rods 58*a*, 58*b* associate movement of the first opposing piston 48*b* with movement the second opposing piston 54*b*. Preferably, movement of the first opposing piston 48*b* opposes movement of the second opposing piston 54*b* where the second crankshaft 18*b* is configured such that the second opposing piston 54*b* moves in accordance with the second mode of operation when the first opposing piston 48*b* is moving in accordance with the first mode of operation. In other words, the arrangement of the second crankshaft 18*b* and the second pair of connecting rods 58*a*, 58*b* is such that the second opposing piston 54*b* moves towards the second piston 54*a* when the first opposing piston 48*b* is moving away from the first piston 48*a*. The gear train 20 of the opposed-piston engine 12 synchronizes rotation of the first and second crankshafts 18*a*, 18*b* such that the first piston 48*a* and the first opposing piston 48*b* begin the first and second modes of operation at the same time and such that the second piston 54*a* and the second opposing piston 54*b* begin the first and second modes of operation at the same time.

Referring generally to FIGS. 2 and 3, a first combustion chamber is disposed within the first cylinder 14*a* between the first piston 48*a* and the first opposing piston 48*b*. A first fuel injector 62 may optionally be provided where the first fuel injector 62 extends through the cylinder wall 38 of the first cylinder liner 36*a* such that the first fuel injector 62 is disposed in fluid communication with the first combustion chamber 60. Thus, the first fuel injector 62 may be operated to inject fuel into the first combustion chamber 60 during the first mode of operation. Where the opposed-piston engine 12 is a compression ignition engine, the fuel injected into the first combustion chamber 60 is compressed and ignites as the first piston 48*a* and the first opposing piston 48*b* approach one another. Alternatively, where the opposed-piston engine 12 is a spark ignition engine, a first spark plug 64 may be provided. The first spark plug 64 may generally extend through the cylinder wall 38 of the first cylinder liner 36*a* such that the first spark plug 64 is disposed in fluid communication with the first combustion chamber 60. The first spark plug 64 may be operated to supply a spark to the first combustion chamber 60 to initiate combustion therein.

Similarly, a second combustion chamber 66 is disposed within the second cylinder 14*b* between the second piston 54*a* and the second opposing piston 54*b*. A second fuel injector 68 may optionally be provided where the second fuel injector 68 extends through the cylinder wall 38 of the second cylinder liner 36*b* such that the second fuel injector 68 is disposed in fluid communication with the second combustion chamber 66. Thus, the second fuel injector 68 may be operated to inject fuel into the second combustion chamber 66 during the first mode of operation. Where the opposed-piston engine 12 is a compression ignition engine, the fuel injected into the second combustion chamber 66 is compressed and ignites as the second piston 54*a* and the second opposing piston 54*b* approach one another. Alternatively, where the opposed-piston engine 12 is a spark ignition engine, a second spark plug 70 may be provided. The second spark plug 70 may generally extend through the cylinder wall 38 of the second cylinder liner 36*b* such that the second spark plug 70 is disposed in fluid communication with the second combustion chamber 66. The second spark plug 70 may be operated to supply a spark to the second combustion chamber 66 to initiate combustion therein. The fuel injectors 62, 68 and the spark plugs 64, 70 may be diametrically arranged relative to the cylinder bores 40. Additionally, the first fuel injector 62 and the second spark plug 70 may be arranged on one side of the engine block assembly 10 while the first spark plug 64 and the second fuel injector 68 are arranged on an opposite side of the engine block assembly 10 (as shown in FIG. 1). Of course, other arrangements are possible and each cylinder 14*a*-14*f* may be equipped with multiple fuel injectors and/or spark plugs.

Still referring to FIGS. 2 and 3, the first and second inlet ports 44, 50 may be positioned longitudinally on one side of the first and second fuel injectors 62, 68 and the first and second exhaust ports 46, 52 may be positioned longitudinally on an opposite side of the first and second fuel injectors 62, 68. For example, the first and second inlet ports 44, 50 in FIGS. 2 and 3 are to the right of the first and second fuel injectors 62, 68 while the first and second exhaust ports 46, 52 are to the left of the first and second fuel injectors 62, 68. An inlet manifold 72 may thus be arranged in fluid communication with the first inlet port 44 and the second inlet port 50. During operation of the opposed-piston engine 12, the inlet manifold 72 transports air to the first inlet port 44 and the second inlet port 50 and thus the first and second combustion chambers 60, 66 respectively. Similarly, an exhaust manifold 74 may be arranged in fluid communication with the first exhaust port 46 and the second exhaust port 52. During operation of the opposed-piston engine 12, the exhaust manifold 74 transports exhaust expelled from the first and second combustion chambers 60, 66 away from the first and second exhaust ports 46, 52.

The cylinder bore 40 of the first cylinder 14*a* and the cylinder bore 40 of the second cylinder 14*b* each has a bore cross-section 76 that is perpendicular to the first and second longitudinal axes 22*a*, 22*b*. The cylinder wall 38 of the first cylinder liner 36*a* and the cylinder wall 38 of the second cylinder liner 36*b* each includes an inner surface 78 facing the pair of first pistons 48*a*, 48*b* and the pair of second pistons 54*a*, 54*b*, respectively. The cylinder wall 38 of the first cylinder liner 36*a* and the cylinder wall 38 of the second cylinder liner 36*b* also includes an outer surface 80 facing away from the pair of first pistons 48*a*, 48*b* and the pair of second pistons 54*a*, 54*b*, respectively. Each piston of the pair of first pistons 48*a*, 48*b* and the pair of second pistons 54*a*, 54*b* has a piston crown 82 spanning the bore cross-section 76 and at least one ring groove 84 that extends annularly about each of the pistons 48*a*, 48*b*, 54*a*, 54*b*. A piston ring 86 is received in each ring groove 84 of each piston 48*a*, 48*b*, 54*a*, 54*b*. The piston rings 86 have an annular shape and extend radially from each of the pistons 48*a*, 48*b*, 54*a*, 54*b* to seal against the inner surface 78 of the cylinder wall 38.

As best seen in FIG. 5, each of the first and second inlet ports 44, 50 and each of the first and second exhaust ports 46, 52 include a plurality of windows 88 that are circumferentially spaced from one another about the cylinder wall 38. Each window of the plurality of windows 88 has a window perimeter that extends about each window of the plurality of windows 88 adjacent the inner surface 78 of the cylinder wall 38. Accordingly, the window perimeters of the plurality of windows 88 cooperatively form the first and second inlet ports 44, 50 and the first and second exhaust ports 46, 52, which may extend circumferentially about the cylinder bore 40.

FIGS. 2 and 3 illustrate the operation of the opposed-piston engine 12. An intake charge of air or an air/fuel mixture is supplied to the first cylinder 14*a* of the opposed-piston engine 12 through the first inlet port 44. This intake charge undergoes combustion within the first cylinder 14*a*. Combustion of the intake charge produces exhaust gasses which exit the first cylinder 14*a* through the first exhaust port 46. Where the opposed-piston engine 12 is a two-stroke engine, the intake charge is compressed by the pair of first pistons 48*a*, 48*b* during the first mode of operation. This compression may cause the intake charge to ignite when the pair of first pistons 48*a*, 48*b* are at or near the top dead-center position, as shown in FIG. 2. The resulting combustion of the intake charge drives the pair of first pistons 48*a*, 48*b* apart during the second mode of operation. Alternatively, spark ignition may be used to control ignition of the intake charge during the first mode of operation. As the pair of first pistons 48*a*, 48*b* are driven apart during the second mode of operation, the pair of first pistons 48*a*, 48*b* pass by the first inlet port 44 and first exhaust port 46 as the pair of first pistons 48*a*, 48*b* move to the bottom dead-center position. In accordance with the outward movement of the pair of first pistons 48*a*, 48*b*, the first inlet port 44 and the first exhaust port 46 are opened and become exposed to the first combustion chamber 60. Exhaust gases thus exit the first cylinder 14*a* through the first exhaust port 46 and a new intake charge enters the first cylinder 14*a* through the first inlet port 44 such that the engine cycle may begin anew. The same sequence occurs in the second cylinder 14*b*, except at different times. Movement of the pair of first pistons 48*a*, 48*b* may be phased 180 degrees apart from movement of the pair of second pistons 54*a*, 54*b* such that the pair of first pistons 48*a*, 48*b* reach the top dead-center position (as shown in FIG. 2) just as the pair of second pistons 54*a*, 54*b* reach the bottom dead-center position (as shown in FIG. 3).

As shown throughout the views, the engine block assembly 10 has a periphery 90 that generally defines geometric outer dimensions of the engine block assembly 10 (e.g. length, width, and height). The engine block assembly 10 has multiple block segments 92*a*, 92*b*, 94, 96 disposed in a side-by-side abutting relationship including a first inboard segment 92*a*, a second inboard segment 92*b*, a first outboard segment 94, and a second outboard segment 96. It should be appreciated that the plurality of cylinder liners 36*a*-36*f* form seamless cylinders within the engine block assembly 10 even though there are seams 97 between the multiple block segments 92*a*, 92*b*, 94, 96. Accordingly, the piston rings 86 do not contact the multiple block segments 92*a*, 92*b*, 94, 96 themselves and thus do not catch on the seams 97 between the multiple block segments 92*a*, 92*b*, 94, 96. The first cylinder liner 36*a* and the second cylinder liner 36*b* may each include a liner support collar 98 disposed intermediately along the longitudinal extent 42 of the first cylinder 36*a* liner and the second cylinder liner 36*b*. As such, the liner support collar 98 is positioned towards the middle of each cylinder liner 36*a*-36*f*, which may or may not be halfway along the longitudinal extent 42 of the cylinder liner 36*a*-36*f*. The liner support collar 98 generally extends annularly about the first and second cylinder liners 36*a*, 36*b* and radially from the outer surface 80 of the first cylinder liner 36*a* and the second cylinder liner 36*b* to form a stop.

With reference to FIGS. 2 through 5, the first inboard segment 92*a* extends longitudinally between a first proximate end 100 and a first distal end 102 and defines a first plurality of bores 104*a*-104*f* (FIG. 4). The first plurality of bores 104*a*-104*f* extend entirely through the first inboard segment 92*a* from the first proximate end 100 to the first distal end 102. Each bore of the first plurality of bores 104*a*-104*f* receives part of one cylinder liner of the plurality of cylinder liners 36*a*-36*f*. For example, FIG. 2 illustrates a first bore 104*a* of the first plurality of bores 104*a*, 104*b* that receives part of the first cylinder liner 36*a*. The first inboard segment 92*a* may also receive at least part of the exhaust manifold 74. The first proximate end 100 of the first inboard segment 92*a* may include a first plurality of counter-bores 106*a*-106*f* (FIG. 5) that extend partially into the first inboard segment 92*a* from the first proximate end 100. Each counter-bore of the first plurality of counter-bores 106*a*-106*f* is coaxially aligned with and extends annularly about one bore of the first plurality of bores 104*a*-104*f*. Each counter-bore of the first plurality of counter-bores 106*a*-106*f* may thus receive part of one liner support collar 98. For example, FIG. 2 illustrates a first counter-bore 106*a* that is coaxially aligned with and that extends annularly about the first bore 104*a* and that receives part of one liner support collar 98.

The second inboard segment 92*b* extends longitudinally between a second proximate end 108 and a second distal end 110 and defines a second plurality of bores 112*a*-112*f* (FIGS. 4 and 5) that extend entirely through the second inboard segment 92*b* from the second proximate end 108 to the second distal end 110. Each bore of the second plurality of bores 112*a*-112*f* receives part of one cylinder liner of the plurality of cylinder liners 36*a*-36*f*. For example, FIG. 2 illustrates a second bore 112*a* of the second plurality of bores 112*a*-112*f* that receives part of the first cylinder liner 36*a*. The second inboard segment 92*b* may optionally receive at least part of the inlet manifold 72, the first and second fuel injectors 62, 68, and the first and second spark plugs 64, 70. The second proximate end 108 of the second inboard segment 92*b* includes a second plurality of counter-bores 114*a*-114*f* (FIGS. 4 and 5) that extend partially into the second inboard segment 92*b* from the second proximate end 108. Each counter-bore of the second plurality of counter-bores 114*a*-114*f* is coaxially aligned with and extends annularly about one bore of the second plurality of bores 112*a*-112*f*. Each counter-bore of the second plurality of counter-bores 114*a*-114*f* may thus receive part of one liner support collar 98. For example, FIG. 2 illustrates a second counter-bore 114*a* of the second plurality of counter-bores 114*a*-114*f* that is coaxially aligned with and that extends annularly about the second bore 112*a* and that receives part of one liner support collar 98.

The first proximate end 100 of the first inboard segment 92*a* and the second proximate end 108 of the second inboard segment 92*b* abut one another. When the first and second inboard segments 92*a*, 92*b* are disposed in this abutting relationship, the first plurality of bores 104*a*-104*f* are aligned with the second plurality of bores 112*a*-112*f* and the first plurality of counter-bores 106*a*-106*f* are aligned with the second plurality of counter-bores 114*a*-114*f*. Accordingly, the first plurality of bores 104*a*-104*f* in the first inboard segment 92*a* and the second plurality of bores 112*a*-112*f* in the second inboard segment 92*b* cooperate to receive the entire longitudinal extent 42 of each cylinder liner of the plurality of cylinder liners 36*a*-36*f*. Similarly, the first plurality of counter-bores 106*a*-106*f* and the second plurality of counter-bores 114*a*-114*f* cooperate to receive the liner support collar 98 disposed about each cylinder liner of the plurality of cylinder liners 36*a*-36*f*. In this way, each cylinder liner of the plurality of cylinder liners 36*a*-36*f* is supported in the middle by the liner support collar 98, which together with the first and second pluralities of counter-bores 106*a*-106*f*, 114*a*-114*f* prevent longitudinal movement of the plurality of cylinder liners 36*a*-36*f* relative to the first and second inboard segments 92*a*, 92*b* of the engine block assembly 10.

Still referring to FIGS. 2 through 5, the first outboard segment 94 extends longitudinally between a third proximate end 116 and a third distal end 118 and at least partially defines a first crankcase 120 therein. The first crankcase 120 receives the first crankshaft 18*a* and the first outboard segment 94 supports at least part of the first crankshaft 18*a*. The third proximate end 116 of the first outboard segment 94 abuts the first distal end 102 of the first inboard segment 92*a* such that the first inboard segment 92*a* is disposed longitudinally between the second inboard segment 92*b* and the first outboard segment 94. The second outboard segment 96 extends longitudinally between a fourth proximate end 122 and a fourth distal end 124 and at least partially defines a second crankcase 126 therein. The second crankcase 126 receives the second crankshaft 18*b* and the second outboard segment 96 supports at least part of the second crankshaft 18*b*. The fourth proximate end 122 of the second outboard segment 96 abuts the second distal end 110 of the second inboard segment 92*b* such that the second inboard segment 92*b* is disposed longitudinally between the first inboard segment 92*a* and the second outboard segment 96.

Optionally, a plurality of seals 128*a*-128*c* (FIGS. 2 and 3) may be provided in the multiple block segments 92*a*, 92*b*, 94, 96. Due to the modular arrangement of the multiple block segments 92*a*, 92*b*, 94, 96, such seals 128*a*-128*c* may be formed by an injection/injection molding process. Such a process for forming the seals 128*a*-128*c* is unsuitable in single-piece block designs because there is not good access to the internal portions of the block where seals are desirable. By way of example and without limitation, the plurality of seals 128*a*-128*c* may include a first group of seals 128*a*, and second group of seals 128*b*, and a third group of seals 128*c*. The first group of seals 128*a* may be provided in each counter-bore of the first and second pluralities of counter-bores 106*a*-106*f*, 114*a*-114*f* in the first proximate end 100 of the first inboard segment 92*a* and the second proximate end 108 of the second inboard segment 92*b*. The first group of seals 128*a* may be annular in shape and may contact each liner support collar 98 to prevent leaks. Thus, each liner support collar 98 may be sandwiched between two seals from the first group of seals 128*a*. The second group of seals 128*b* may be provided in the first plurality of bores 104*a*-104*f* of the first inboard segment 92*a* adjacent the exhaust manifold 74. The second group of seals 128*b* contact the exhaust manifold 74 to prevent leaks between the first and second exhaust ports 46, 52 and the exhaust manifold 74. Thus, a portion of the exhaust manifold 74 adjacent the plurality of cylinder liners 36*a*-36*f* may be sandwiched between seals from the second group of seals 128*b*. The third group of seals 128*c* may be provided in the second plurality of bores 112*a*-112*f* of the second inboard segment 92*b* adjacent the inlet manifold 72. The third group of seals 128*c* contact the inlet manifold 72 to prevent leaks between the first and second inlet ports 44, 50 and the inlet manifold 72. Thus, a portion of the inlet manifold 72 adjacent the plurality of cylinder liners 36*a*-36*f* may be sandwiched between seals from the third group of seals 128*c*.

As best seen in FIG. 4, the first outboard segment 94 and the second outboard segment 96 are made of a mesh of interconnected members 130. In other words, the first outboard segment 94 and the second outboard segment 96 are frame-like constructions that support the first crankshaft 18*a* and the second crankshaft 18*b*, respectively. The first outboard segment 94 and the second outboard segment 96 include a plurality of crankshaft races 132 disposed along the mesh of interconnected members 130. The plurality of crankshaft races 132 supports the first and second crankshafts 18*a*, 18*b* at multiple locations along the first outboard segment 94 and the second outboard segment 96. A plurality of crankshaft clamps 134 are removably coupled to the first outboard segment 94 and the second outboard segment 96 at the plurality of crankshaft races 132. By way of example and without limitation, the each crankshaft clamp of the plurality of crankshaft clamps 134 may be bolted to a corresponding crankshaft race of the plurality of crankshaft races 132. The plurality of crankshaft clamps 134 and the plurality of crankshaft races 132 thus cooperate to hold the first and second crankshafts 18*a*, 18*b* in place with respect to the first outboard segment 94 and the second outboard segment 96. At the same time, the plurality of crankshaft clamps 134 and the plurality of crankshaft races 132 permit rotation of the first crankshaft 18*a* about the first rotational axis 24*a* and rotation of the second crankshaft 18*b* about the second rotational axis 24*b*. For example, each crankshaft race of the plurality of crankshaft races 132 may have a semi-cylindrical shape and each crankshaft clamp of said plurality of crankshaft clamps 134 may have a semi-cylindrical shape that opposes the semi-cylindrical shape of the crankshaft race 132 such that each crankshaft race 132 and the corresponding crankshaft clamp 134 cooperate to circumscribe a portion of the first crankshaft 18*a* or the second crankshaft 18*b*.

Referring to FIGS. 2 through 4, the opposed-piston engine 12 includes a housing 136 that is disposed about the periphery 90 of the engine block assembly 10. Because the mesh of interconnected members 130 forming the first and second outboard segments 94, 96 has holes 138 exposing the first and second crankshafts 18*a*, 18*b*, the housing 136 at least partially encloses the first inboard segment 92*a*, the second inboard segment 92*b*, the first outboard segment 94, and the second outboard segment 96. Accordingly, the housing 136 and the mesh of interconnected members 130 cooperate to form the first crankcase 120 and the second crankcase 126.

As best seen in FIG. 1, a plurality of support passageways 140 extend longitudinally through the first inboard segment 92*a*, the second inboard segment 92*b*, the first outboard segment 94, and the second outboard segment 96. The plurality of support passageways 140 run adjacent the periphery 90 of the engine block assembly 10 and are open to the third distal end 118 of the first outboard segment 94 and the fourth distal end 124 of the second outboard segment 96. A plurality of tensile members 142 disposed in the plurality of support passageways 140 extend longitudinally through the engine block assembly 10 from the third distal end 118 of the first outboard segment 94 to the fourth distal end 124 of the second outboard segment 96. The plurality of tensile members 142 therefore tie the first inboard segment 92*a*, the second inboard segment 92*b*, the first outboard segment 94, and the second outboard segment 96 together as one unit. Each support passageway of the plurality of support passageways 140 receives one tensile member of the plurality of tensile members 142. The plurality of tensile members 142 may take a variety of different forms and may be made of a variety of different materials without departing from the scope of the present disclosure. By way of example and without limitation, each tensile member of the plurality of tensile members 142 may be a rod with a pair of threaded ends 144 that receive nuts 146. Rotation of the nuts 146 about the threaded ends 144 forces the first inboard segment 92*a*, the second inboard segment 92*b*, the first outboard segment 94, and the second outboard segment 96 together, thereby closing the seams 97 between the multiple block segments 92*a*, 92*b*, 94, 96.

As illustrated in FIG. 2, combustion occurs in the first cylinder 14*a* at about the same time the pair of first pistons 48*a*, 48*b* approach the top dead-center position. The first pair of connecting rods 56*a*, 56*b* more specifically includes a first connecting rod 56*a* coupled to the first piston 48*a* and the second pair of connecting rods 58*a*, 58*b* includes a second connecting rod 58*b* coupled to the first opposing piston 48*b*. Combustion drives the pair of first pistons 48*a*, 48*b* apart and exerts longitudinal forces 148 on the first and second connecting rods 56*a*, 58*b*. In turn, the longitudinal forces 148 are transmitted from the first and second connecting rods 56*a*, 58*b* to the first and second crankshafts 18*a*, 18*b*. Due to the arrangement of the pair of first pistons 48*a*, 48*b* in the opposed-piston engine 12, both the first crankshaft 18*a* and the second crankshaft 18*b* experience equal and opposite longitudinal forces 148 in an outward direction as combustion occurs. The first and second outboard segments 94, 96 support the first and second crankshaft 18*a*, 18*b* and thus receive these opposing longitudinal forces 148 from the first and second crankshafts 18*a*, 18*b*. As a result, the opposing longitudinal forces 148 applied to the first and second crankshafts 18*a*, 18*b*, and thus the first and second outboard segments 94, 96 are oriented in a direction facing away from the first inboard segment 92*a* and the second inboard segment 92*b* during every combustion event. This loads the plurality of tensile members 142 in tension during every combustion event. Advantageously, the plurality of tensile members 142 transmit the longitudinal forces 148 across the multiple block segments 92*a*, 92*b*, 94, 96 such that the longitudinal forces 148 acting on the first outboard segment 94 and the longitudinal forces 148 acting on the second outboard segment 96 substantially cancel out. As the first crankshaft 18*a* is attempting to drive the first outboard segment 94 outwardly away from the first inboard segment 92*a*, the plurality of tensile members 142 applies an inward force 150 against the second outboard segment 96. At the same time, as the second crankshaft 18*b* is attempting to drive the second outboard segment 96 outwardly away from the second inboard segment 92*b*, the plurality of tensile members 142 applies an inward force 150 against the first outboard segment 94. In other words, the longitudinal forces 148 transmitted to the first and second outboard segments 94, 96 by the plurality of tensile members 142 (creating the inward forces 150) oppose the longitudinal forces 148 applied to the first and second outboard segments 94, 96 by the first and second crankshafts 18*a*, 18*b*. As a result, the multiple block segments 92*a*, 92*b*, 94, 96 are held together by the plurality of tensile members 142. Additionally, each segment of the multiple block segments 92*a*, 92*b*, 94, 96 may be made lighter by utilizing less material (i.e. reduced wall thicknesses) and/or lighter materials relative to that required by other opposed-piston engine designs since the plurality of tensile members 142 reduce the localized loading experienced by the multiple block segments 92*a*, 92*b*, 94, 96 relative to other opposed-piston engine designs. Further, the multiple block segments 92*a*, 92*b*, 94, 96 allow the opposed-piston engine 12 to be assembled with cylinder liners 36*a*-36*f* that are supported in the middle by liner support collars 98. This yields improved and more complete support for the cylinder liners 36*a*-36*f* while eliminating the need for complicated machining of the first plurality of cylinder bores 104*a*-104*f*, the second plurality of cylinder bores 112*a*-112*f*, and the cylinder liners 36*a*-36*f*.

It should be appreciated that the opposed-piston engine 12 may vary in many respects without departing from the scope of the present disclosure. For example, the engine block assembly 10 may have a different number of segments than the four segments shown in the Figures. By way of example and without limitation, it is envisioned that the first and second inboard segments 92*a*, 92*b* could be combined as a single inboard segment. Additionally, the length of the cylinder liners 36*a*-36*f* relative to the multiple block segments 92*a*, 92*b*, 94, 96 may vary. By way of example and without limitation, the cylinder liners 36*a*-36*f* may extend into the first and second outboard segments 94, 96 or may alternatively terminate inboard of the first distal end 102 of the first inboard block segment 92*a* and the second distal end 110 of the second inboard block segment 92*b*. It should further be appreciated that the opposed-piston engine 12 may have a different number of tensile members 142 than the eight shown. Many other modifications and variations of the present invention are possible in light of the above teachings and may be practiced otherwise than as specifically described while within the scope of the appended claims. These antecedent recitations should be interpreted to cover any combination in which the inventive novelty exercises its utility. The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described.

What is claimed is:

1. An engine assembly comprising:

an engine block;

a first cylinder liner disposed within said engine block, said first cylinder liner having a longitudinal extent equaling a predetermined length and said first cylinder having a first longitudinal axis that extends coaxially through said first cylinder liner;

said first cylinder liner having a cylinder wall presenting an inner surface that defines a first cylinder within said first cylinder liner and an outer surface that is opposite said inner surface;

said engine block having multiple block segments disposed in a side-by-side abutting relationship including a first inboard segment, a second inboard segment, a first outboard segment, and a second outboard segment;

said first inboard segment extending longitudinally between a first proximate end and a first distal end and defining a first bore that is open to said first proximate and distal ends;

said second inboard segment extending longitudinally between a second proximate end and a second distal end and defining a second bore that is open to said second proximate and distal ends;

said first proximate end of said first inboard segment and said second proximate end of said second inboard segment abutting one another where said first bore is aligned with said second bore such that said first and second bores jointly receive said first cylinder liner;

said first outboard segment extending longitudinally between a third proximate end and a third distal end, said third proximate end abutting said first distal end of said first inboard segment such that said first inboard segment is disposed longitudinally between said second inboard segment and said first outboard segment;

said second outboard segment extending longitudinally between a fourth proximate end and a fourth distal end, said fourth proximate end abutting said second distal end of said second inboard segment such that said second inboard segment is disposed longitudinally between said first inboard segment and said second outboard segment;

a plurality of tensile members extending longitudinally through said first and second inboard segments and said first and second outboard segments of said engine block to tie said first and second inboard segments and said first and second outboard segments together as one unit;

first and second crankshafts; and a plurality of crankshaft clamps securing the first and second crankshafts to the first and second outboard segments, said plurality of crankshaft clamps being removably coupled to said third proximate end of said first outboard segment and said fourth proximate end of said second outboard segment.

2. An engine assembly as set forth in claim 1, wherein said first bore extends entirely through said first inboard segment from said first proximate end to said first distal end and said second bore extends entirely through said second inboard segment from said second proximate end to said second distal end.

3. An engine assembly as set forth in claim 1, further comprising:

a pair of pistons disposed in said first cylinder liner that are movable along said first longitudinal axis toward one another in a first mode of operation and away from one another along said first longitudinal axis in a second mode of operation between a bottom dead-center position and a top dead-center position.

4. An engine assembly as set forth in claim 3, wherein said first outboard segment at least partially defines a first crankcase that receives said first crankshaft and said second outboard segment at least partially defines a second crankcase that receives said second crankshaft.

5. An engine assembly as set forth in claim 1, wherein said first outboard segment and said second outboard segment are made of a plurality of interconnected members.

6. An engine assembly as set forth in claim 5, further comprising:

a housing disposed about said engine block that at least partially encloses said first outboard segment, said first inboard segment, said second inboard segment, and said second outboard segment.

7. An engine assembly as set forth in claim 1, further comprising:

a plurality of support passageways extending longitudinally through said first inboard segment and said second inboard segment that each receive one tensile member of said plurality of tensile members.

8. An engine assembly as set forth in claim 1, further comprising:

a first exhaust port extending through said first cylinder liner; and an exhaust manifold at least partially disposed within said first inboard segment of said engine block that is arranged in fluid communication with said first exhaust port for transporting exhaust away from said first exhaust port.

9. An engine assembly as set forth in claim 8, further comprising:

a group of seals disposed in said first bore of said first inboard segment adjacent to said first exhaust port and on opposite sides of said exhaust manifold that contact said exhaust manifold to prevent leaks between said exhaust manifold and said first exhaust port.

10. An engine assembly as set forth in claim 9, wherein said group of seals are directly applied to said first inboard segment by a liquid injection process.

11. An engine assembly as set forth in claim 1, further comprising:

a first inlet port extending through said first cylinder liner; and an inlet manifold at least partially disposed within said second inboard segment of said engine block that is arranged in fluid communication with said first inlet port for transporting air to said first inlet port.

12. An engine assembly as set forth in claim 11, further comprising:

a group of seals disposed in said second bore of said second inboard segment adjacent to said first inlet port and on opposite sides of said inlet manifold that contact said inlet manifold to prevent leaks between said inlet manifold and said first inlet port.

13. An engine assembly as set forth in claim 12, wherein said group of seals are directly applied to said second inboard segment by a liquid injection process.

14. An engine assembly as set forth in claim 1, further comprising:

a first fuel injector at least partially disposed within said first inboard segment of said engine block that extends through said first cylinder liner to supply fuel to said first cylinder.

15. An engine assembly as set forth in claim 1, wherein said first and second bores of said first and second inboard segments of said engine block cooperate to entirely receive said first cylinder liner.

16. An engine assembly as set forth in claim 1, wherein said first cylinder liner includes a liner support collar disposed intermediately along said longitudinal extent of said first cylinder liner that extends annularly about and radially from said outer surface of said first cylinder liner to form a stop, wherein said first proximate end of said first inboard segment includes a first counter-bore extending into said first inboard segment that is coaxially aligned with and arranged annularly about said first bore, wherein said second proximate end of said second inboard segment includes a second counter-bore extending into said second inboard segment that is coaxially aligned with and arranged annularly about said second bore, and wherein said first counter-bore and said second counter-bore cooperate to receive said liner support collar of said first cylinder liner.

17. An engine assembly as set forth in claim 16, further comprising:

seals disposed in said first counter-bore of said first inboard segment and said second counter-bore of said second inboard segment on opposite sides of said liner support collar of said first cylinder liner that contact said liner support collar to prevent leaks between said first cylinder liner and said first and second inboard segments.

18. An engine assembly as set forth in claim 17, wherein said seals are directly applied to said first and second inboard segments by a liquid injection process.

19. An engine assembly as set forth in claim 16, wherein said first proximate end of said first inboard segment and said second proximate end of said second inboard segment abut one another at a seam, said seam being disposed intermediately along said longitudinal extent of said first cylinder liner such that said seam is adjacent to said counter-bore.

20. An engine assembly as set forth in claim 16, further comprising:

a first inlet port extending through said first cylinder liner; and a first exhaust port extending through said first cylinder liner, said first exhaust port being longitudinally spaced from said first inlet port.

21. An engine assembly as set forth in claim 20, wherein said liner support collar is positioned longitudinally between said first inlet port and said first exhaust port.

22. An engine assembly as set forth in claim 20, wherein said first exhaust port and said first inlet port each includes a plurality of windows that extend through said first cylinder liner and are circumferentially spaced from one another about said first cylinder liner.

23. An engine assembly as set forth in claim 1, wherein said third proximate end of said first outboard segment and said fourth proximate end of said second outboard segment include a plurality of crankshaft races that cooperate with said plurality of crankshaft clamps to hold said first and second crankshafts in place with respect to said first and second outboard segments.

24. An engine assembly as set forth in claim 23, wherein each crankshaft race in said plurality of crankshaft races and each crankshaft clamp in said plurality of crankshaft clamps has a semi-cylindrical shape that circumscribes a portion of one of said first and second crankshafts.

25. An engine assembly as set forth in claim 24, wherein said semi-cylindrical shape of each crankshaft race in said plurality of crankshaft races opens towards said first and second inboard segments of said engine block and wherein said semi-cylindrical shape of each crankshaft clamp in said plurality of crankshaft clamps opens away from said first and second inboard segments of said engine block.

26. An engine assembly as set forth in claim 24, wherein said semi-cylindrical shape of each crankshaft race in said plurality of crankshaft races faces inward towards said first and second inboard segments and wherein said semi-cylindrical shape of each crankshaft clamp in said plurality of crankshaft clamps faces outward away from said first and second inboard segments of said engine block.

27. An engine assembly as set forth in claim 1, wherein said plurality of crankshaft clamps includes a first set of crankshaft clamps positioned longitudinally between said first crankshaft and said first inboard segment of said engine block and a second set of crankshaft clamps positioned longitudinally between said second crankshaft and said second inboard segment of said engine block.

* * * * *